US008995872B2

(12) United States Patent
Ito et al.

(10) Patent No.: US 8,995,872 B2
(45) Date of Patent: Mar. 31, 2015

(54) DEVELOPING DEVICE PROVIDED WITH DEVELOPING ROLLER AND THICKNESS REGULATING BLADE

(75) Inventors: Yoshinori Ito, Nagoya (JP); Hirofumi Kuriki, Nagoya (JP); Ryuya Yamazaki, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 412 days.

(21) Appl. No.: 13/351,479

(22) Filed: Jan. 17, 2012

(65) Prior Publication Data

US 2012/0251162 A1 Oct. 4, 2012

(30) Foreign Application Priority Data

Mar. 31, 2011 (JP) ..... 2011-077200

(51) Int. Cl.
*G03G 15/08* (2006.01)
*G03G 15/04* (2006.01)

(52) U.S. Cl.
CPC ..... *G03G 15/0812* (2013.01); *G03G 15/0898* (2013.01); *G03G 2215/0141* (2013.01)
USPC ..... 399/103; 399/105; 399/119; 399/284

(58) Field of Classification Search
CPC ..... G03G 15/0812; G03G 15/0898
USPC ..... 399/103, 105, 119, 284
See application file for complete search history.

(56) References Cited

U.S. PATENT DOCUMENTS

2003/0123899 A1 7/2003 Kamimura
2006/0269317 A1* 11/2006 Fukuta ..... 399/103

FOREIGN PATENT DOCUMENTS

JP 2003-195628 A 7/2003
JP 2006-330619 A 12/2006
JP 2009-288475 A 12/2009

OTHER PUBLICATIONS

Machine translation of JP 2009-288475.*
State Intellectual Property Office of the People'S Republic of China, First Office Action for Chinese Patent Application No. 201210021923.6 (counterpart to above-captioned patent application), mailed Oct. 24, 2013.
Japan Patent Office, Decision of Rejection for Japanese Patent Application No. 2011-077200 (counterpart to above-captioned patent application), mailed Apr. 2, 2013.
Office Action issued in Chinese Patent Application No. 201210021923.6, mailed Jul. 7, 2014.

* cited by examiner

*Primary Examiner* — David Gray
*Assistant Examiner* — Andrew V Do
(74) *Attorney, Agent, or Firm* — Merchant & Gould PC

(57) ABSTRACT

The developing device includes a casing, a developing roller, a thickness regulating blade, and a seal member. The developing roller has an outer peripheral surface carrying developer. The thickness regulating blade is configured to regulate a thickness of the developer carried on the outer peripheral surface and has an opposed surface confronting the casing. The thickness regulating blade further has one end part supported on the casing and another end part provided with a press member in sliding contact with the outer peripheral surface. The press member is located on the opposed surface and protrudes toward the developing roller. The press member is formed with a receiving portion depressed inward at its widthwise ends in an axial direction of the developing roller. The seal member is disposed between the thickness regulating blade and the casing and contacting at least a part of the receiving portion.

8 Claims, 6 Drawing Sheets

DEVELOPING DEVICE PROVIDED WITH DEVELOPING ROLLER AND THICKNESS REGULATING BLADE

CROSS REFERENCE TO RELATED APPLICATION

This application claims priority from Japanese Patent Application No. 2011-077200 filed Mar. 31, 2011. The entire content of this priority application is incorporated herein by reference.

TECHNICAL FIELD

The present invention relates to a developing device provided with a developing roller and a thickness regulating blade for regulating a thickness of developing agent deposited on the developing roller.

BACKGROUND

A conventional developing device includes a casing, a developing roller carrying developing agent thereon, a thickness regulating blade slidingly contacting the developing roller and regulating a thickness of the developing agent carried on the developing roller, and a plurality of seal members preventing the developing agent from leaking from a gap between the thickness regulating blade and the developing roller. The thickness regulating blade is provided with a press member in sliding contact with the developing roller.

The seal member includes an upper side seal located between the thickness regulating blade and the casing, and a blade side seal located at each width end of the press member. The upper side seal is configured to prevent a developing agent from leaking from a base portion of the thickness regulating blade. The blade side seal is configured to prevent the developing agent from leaking from a gap among the thickness regulating blade, the casing, and the developing roller.

SUMMARY

The conventional developing device includes a plurality of seal members, increasing manufacturing cost.

The seal member is disposed on a surface in confrontation with the casing of the thickness regulating blade, and provided at a position outside of both ends of the press member in a longitudinal direction of the press member. If a gap is accidentally generated among the press member, the seal member, and the developing roller, the developing agent leaks from the gap.

In view of the foregoing, it is an object of the invention to provide a developing device capable of reducing the number of a seal member for preventing a toner leakage and capable of providing the seal member without a gap when a press member is provided on a surface in confrontation with a casing of the developing device.

In order to attain the above and other objects, the invention provides a developing device. The developing device includes a casing, a developing roller, a thickness regulating blade, and a seal member. The casing accommodates developer therein. The developing roller is rotatably provided in the casing and has an outer peripheral surface carrying the developer. The thickness regulating blade is configured to regulate a thickness of the developer carried on the outer peripheral surface and has an opposed surface confronting the casing. The thickness regulating blade further has one end part supported on the casing and another end part provided with a press member in sliding contact with the outer peripheral surface. The press member is located on the opposed surface and protrudes toward the developing roller. The press member is formed with a receiving portion depressed inward at its widthwise ends in an axial direction of the developing roller. The seal member is disposed between the thickness regulating blade and the casing and contacting at least a part of the receiving portion.

BRIEF DESCRIPTION OF THE DRAWINGS

The particular features and advantages of the invention as well as other objects will become apparent from the following description taken in connection with the accompanying drawings, in which:

FIG. 4(*b*) is an enlarged bottom view of the left end portion of the thickness regulating blade;

FIG. 5(*b*) is an enlarged cross-sectional view of a press member;

FIG. 6(*b*) is an enlarged bottom view of the left end portion of the thickness regulating blade according to the modification of the embodiment;

DETAILED DESCRIPTION

An embodiment of the invention will be described while referring to the accompanying drawings. An overall structure of a color laser printer 1 in which a developing device according to the present invention is mounted will be briefly described, and after that technical features of the present embodiment will be described in detail.

Figure 1:
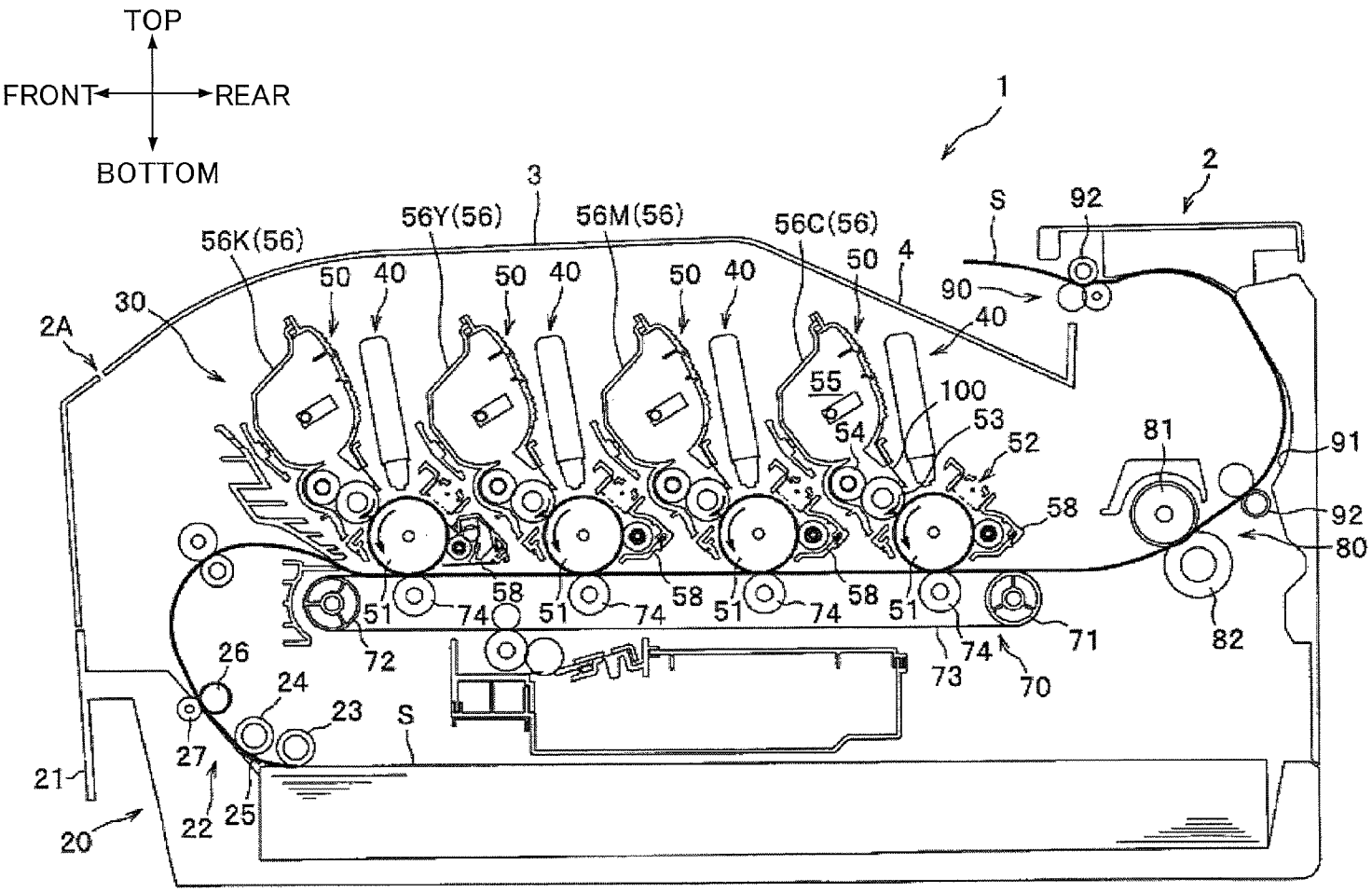
FIG. 1 is a schematic cross-sectional view showing an overall structure of a color laser printer according to an embodiment of the invention.

Throughout the specification, the expressions "front", "rear", "above", "below", and "laterally" are used herein to define the various parts when the color laser printer 1 is disposed in an orientation in which it is intended to be used. For example, a left side in FIG. 1 is a front side with respect to a user, a right side in FIG. 1 is a rear side, a front side of FIG. 1 is a right side, and a back side of FIG. 1 is a left side.

[Overall Structure of Color Laser Printer]

The color laser printer 1 has a main body 2 in which provided are a sheet supply section 20 for supplying a sheet S, an image forming section 30 for forming an image on the sheet S, and a sheet discharging section 90 for discharging the sheet S carrying a color image thereon.

The main body 2 has an upper portion formed with an opening 2A and an upper cover 3 pivotally supported thereon for exposing and closing the opening 2A. The upper cover 3 has a top surface serving as a discharge tray 4 on which the discharged sheet S from the main body 2 is stacked.

The sheet supply section 20 disposed at a bottom portion of the main body 2 includes a sheet supply tray 21 detachably mounted to the main body 2, a sheet supplying mechanism 22 for conveying the sheet S from the sheet supply tray 21 to the image forming section 30. The sheet supplying mechanism 22 is disposed at a front portion of the sheet supply tray 21 and includes a sheet supply roller 23, a separation roller 24, a separation pad 25, a paper dust roller 26, and a pinch roller 27.

In the sheet supply section 20, the sheet S stacked on the sheet supply tray 21 is fed upward one by one, passes between the paper dust roller 26 and the pinch roller 27 so that the paper dust is removed therefrom, follows a U-shaped path through a conveying path (not shown), and supplied to the image forming section 30.

The image forming section 30 mainly includes four LED (light emitting diode) units 40, four process cartridges 50, a transfer unit 70, and a fixing unit 80.

The LED unit 40 is pivotably connected to an LED supporting member (not shown) disposed below the upper cover 3 and is arbitrarily fixed to a fixing member (not shown) provided on the main body 2.

The four process cartridges 50 are juxtaposed in a front/rear direction at a position between the upper cover 3 and the sheet supply section 20, and includes a drum cartridge 58 and a developer cartridge 56 detachably mounted to the drum cartridge 58.

The drum cartridge 58 includes a photosensitive drum 51 and a charger 52. The drum cartridge 58 may be either detachably mounted to the main body 2 or fixedly provided in the main body 2.

The developer cartridge 56 includes a casing 200 (FIG. 2) defining a toner accommodating chamber 55 for accommodating toner, a developing roller 53, a supply roller 54, and a thickness regulating blade 100.

The four developer cartridges 56K, 56Y, 56M, and 56C respectively accommodate black (K), yellow (Y), magenta (M), and cyan (C) toner. These cartridges are arranged in the stated order from an upstream side in a sheet feeding direction.

The transfer unit 70 is disposed between the sheet supply section 20 and the process cartridge 50 and includes a drive roller 71, a follower roller 72, an endless transfer belt 73, and a transfer roller 74.

The drive roller 71 and the follower roller 72 are arranged in parallel with and away from each other in the front/rear direction. The transfer belt 73 is stretched between the drive roller 71 and the follower roller 72 and has an outer surface in contact with each photosensitive drum 51. Four transfer rollers 74 are disposed inside the transfer belt 73 and confronts corresponding photosensitive drum 51, with the transfer belt 73 interposed therebetween. A transfer bias (transfer voltage) opposite in polarity to the toner is applied to the transfer roller 74 under a constant current control during a transfer operation.

The fixing unit 80 is disposed on the rear side of the process cartridge 50 and the transfer unit 70. The fixing unit 80 includes a heating roller 81 and a pressure roller 82 facing the heating roller 81 and applying a pressure to the same.

The sheet discharging section 90 includes a sheet discharge path 91 running upward from the fixing unit 80 and turning forward, and a plurality of conveying rollers 92 conveying the sheet S.

In a color print mode, an outer surface of each of the photosensitive drums 51 is charged by the charger 52 and exposed by the LED unit 40, so that the potential level of the exposed portion becomes lower than the remaining portion on the outer surface, thereby forming an electrostatic latent image on the photosensitive drum 51 based on image data. The toner accommodated in the toner accommodating chamber 55 is supplied to the developing roller 53 by the supply roller 54, regulated to a prescribed uniform thickness by the thickness regulating blade 100, and then deposited on the developing roller 53.

The toner carried on the developing roller 53 is supplied to the electrostatic latent image formed on the photosensitive drum 51. As a result, the electrostatic latent image is developed into a visible toner image.

The sheet S supplied on the transfer belt 73 passes between each photosensitive drum 51 and each transfer roller 74 located within the transfer belt 73, transferring the toner image formed on the photosensitive drum 51 onto the sheet S. The sheet S passes between the heating roller 81 and the pressure roller 82, so that the toner image transferred onto the sheet S is thermally fixed.

The sheet S with thermally fixed toner image is conveyed through the sheet discharge path 91 by the conveying rollers 92, discharged outside of the main body 2, and stacked on the discharge tray 4.

[Developer Cartridge]

Figure 2:
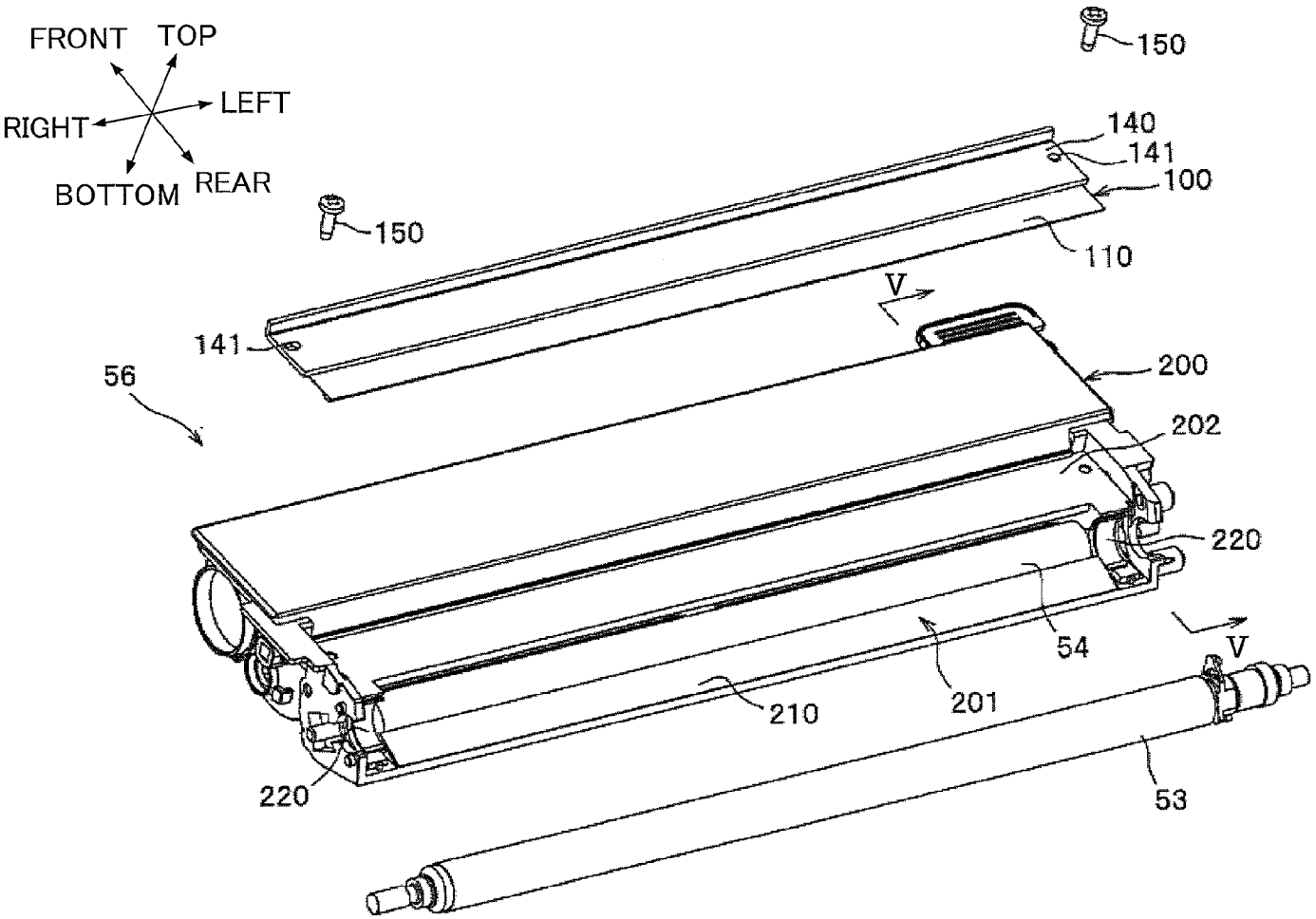
FIG. 2 is an exploded perspective view of a developer cartridge from which a thickness regulating blade and a developing roller are removed.

Next, the detailed construction of the developer cartridge 56 will be described. A direction will be used throughout the following description assuming that the developer cartridge 56 is transversely disposed. That is, as shown in FIG. 2, a side to which the thickness regulating blade 100 is mounted as viewed from the casing 200 defines "upward", and the opposite side "downward". A side at which the developing roller 53 is disposed with respect to the casing 200 defines "rear", and the opposite side defines "front". Based on the upward/downward direction and the front/rear direction, "right" and "left" are defined.

As shown in FIG. 2, the casing 200 has a rear side wall formed with an elongated opening 201. The developing roller 53 is rotatably supported on the casing 200 so as to cover the opening 201. The opening 201 has a lower portion provided with a film 210 and widthwise end portions provided with a side seal 220. A mounting surface 202 to which the thickness regulating blade 100 is to be mounted is disposed above the opening 201.

The side seal 220 is curved to follow a circumferential surface of the developing roller 53 and is in sliding contact with the developing roller 53. The film 210 is in sliding contact with a lower portion of the developing roller 53, and the thickness regulating blade 100 is in sliding contact with the upper portion of the developing roller 53. The developing roller 53 is surrounded by the thickness regulating blade 100, the film 210, and the side seal 220 in the upward/downward and rightward/leftward directions, thereby preventing the toner in the casing 200 from leaking from the shielded portion of the developing roller 53.

Figure 3:
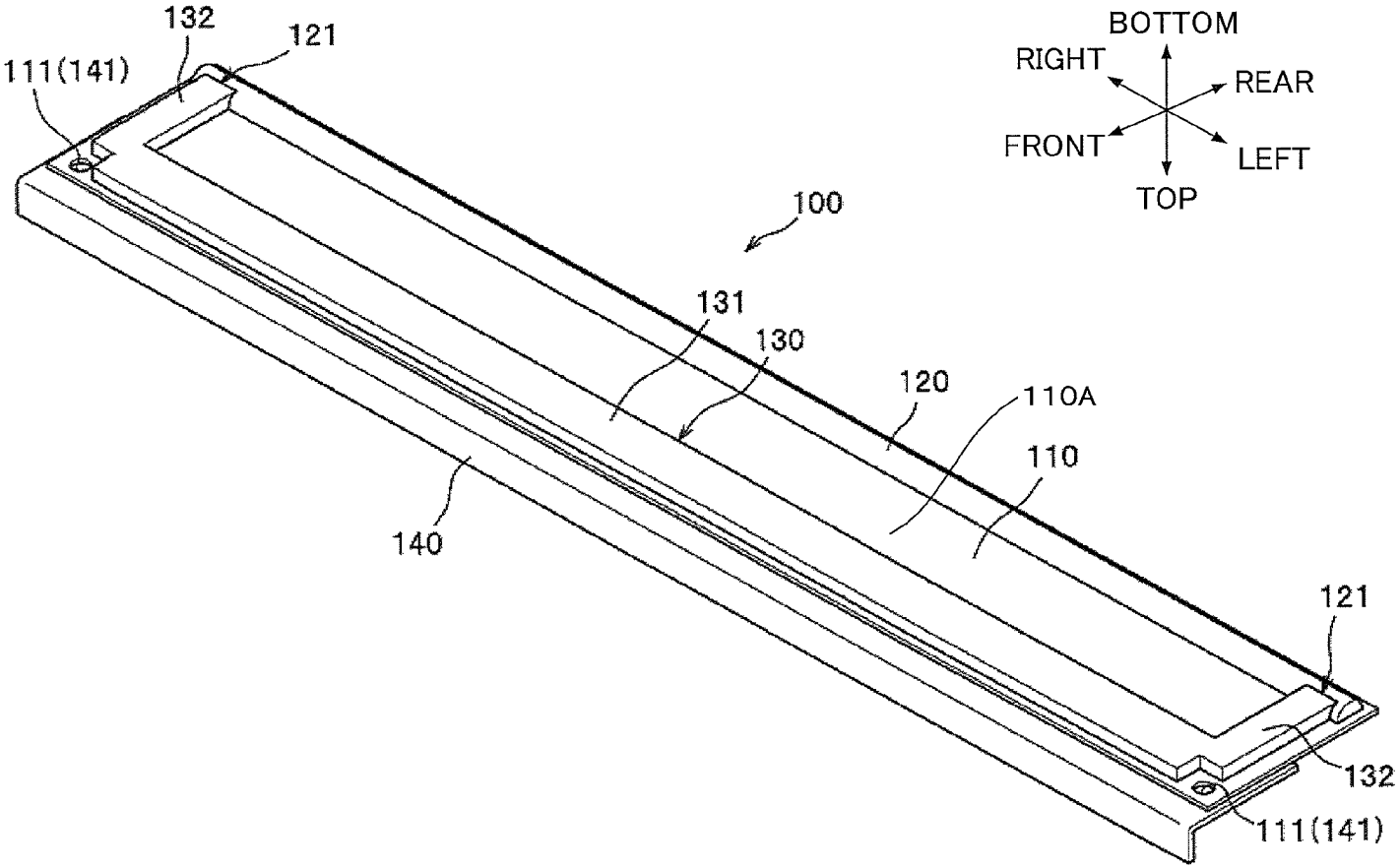
FIG. 3 is a perspective view of the thickness regulating blade as viewed from reverse side.

The thickness regulating blade 100 slidingly contacts the developing roller 53 to regulate a thickness of the toner thereon. The thickness regulating blade 100 has a base part fixed to the mounting surface 202 and a free end part in sliding contact with the developing roller 53. As shown in FIG. 3, the thickness regulating blade 100 is configured of a metallic plate 110 and a reinforcing member 140.

The metallic plate 110 is in contact with the developing roller 53 and made of substantially thin rectangular metallic plate. The metallic plate 110 has an opposed surface 110A facing the casing 200 provided with a press member 120 and a seal member 130.

Figure 4A:
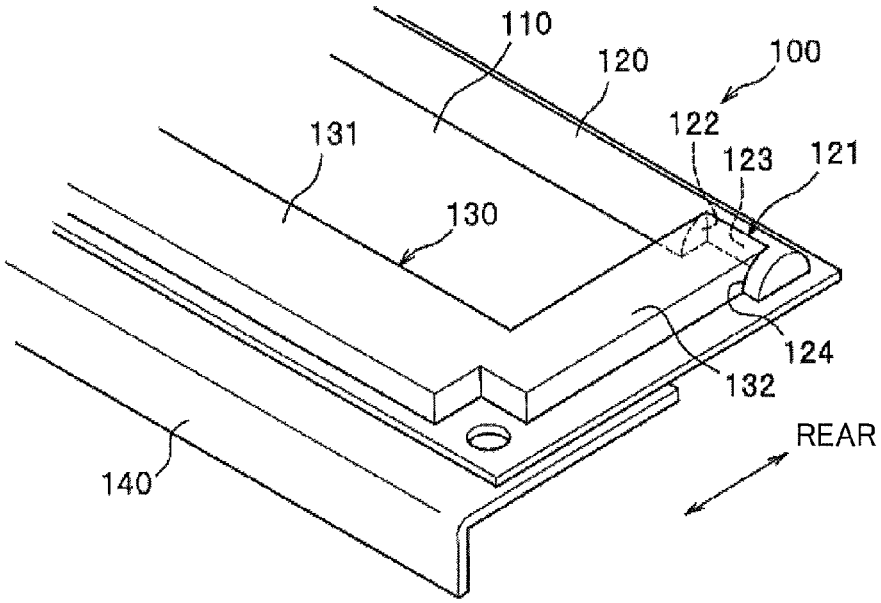
FIG. 4(*a*) is an enlarged perspective view of a left end portion of the thickness regulating blade.
Figure 4B:
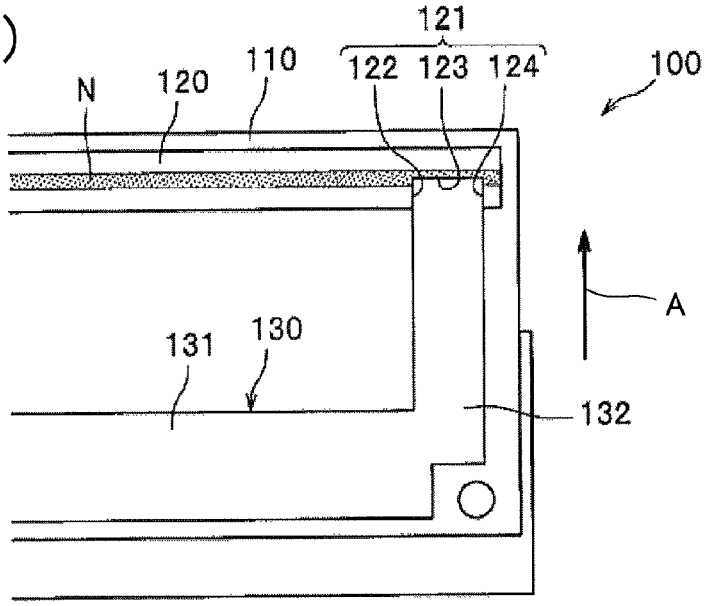

The press member 120 is formed of a rubber or the like and in sliding contact with the circumferential surface of the developing roller 53. The press member 120 protrudes from the free end part of the thickness regulating blade 100 toward the developing roller 53. Specifically, as shown in FIG. 4(*a*), the press member 120 has a semicircular cross-section and extends from one widthwise end of the developing roller 53 to the other in an axial direction of the developing roller 53. The press member 120 has a contact part N in direct sliding contact with the developing roller 53. The contact part N is disposed furthest from the metallic plate 110 on the press member 120 in top-to-bottom direction and extends in the axial direction.

The press member 120 has widthwise ends portion formed with a concave part 121 positioned at a front side (upstream side in a rotational direction of the developing roller 53, shown in arrow A of FIG. 4(*b*)) and depressed rearward (downstream side in the rotational direction of the developing roller 53). The concave part 121 is of substantially squared U-shape and includes a first side surface 122, a depth-side surface 123, and a second side surface 124.

Figure 5A:
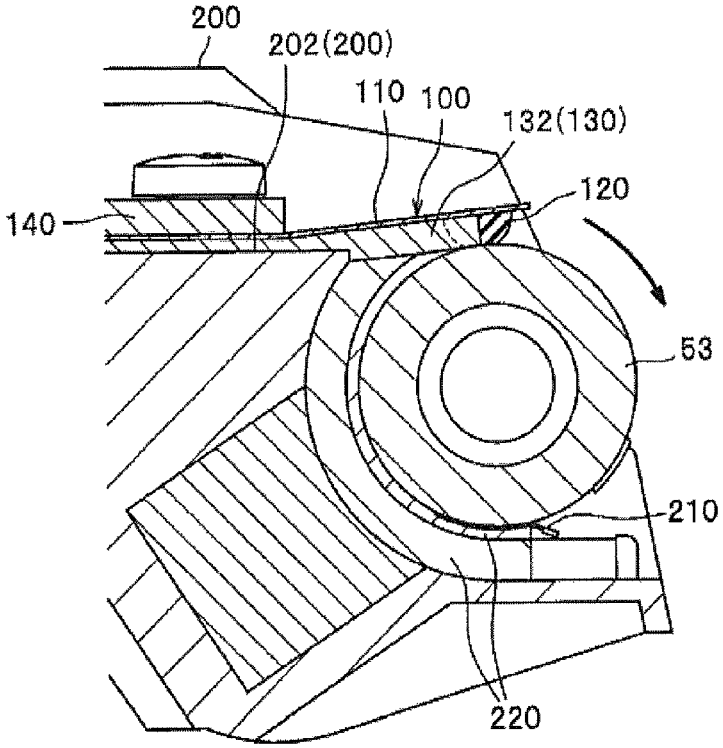
FIG. 5(*a*) is a partial cross-sectional view taken along a line V-V in FIG. 2.
Figure 5B:
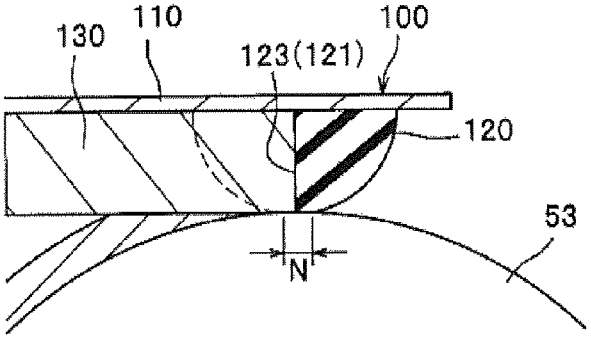

The first side surface 122 extends in front/rear direction (rotational direction of the developing roller 53). The depth-side surface 123 extends in the axial direction from a rear end portion (the most downstream side in the rotational direction of the developing roller 53) of the first side surface 122. As shown in FIG. 5(*b*), the depth-side surface 123 extends orthogonal to the opposed surface 110A of the metallic plate 110. The depth-side surface 123 is aligned with the contact part N as shown in a hatching area of FIG. 4(*b*). The second side surface 124 extends from an outside end portion of the depth-side surface 123 toward the upstream side in the rotational direction of the developing roller 53 so as to be in confrontation with the first side surface 122.

The seal member 130 is made of a sponge or the like. The seal member 130 has a thickness greater than that of the press member 120 before the thickness regulating blade 100 is assembled in the casing 200, whereas the seal member 130 has a thickness equivalent to the press member 120 due to the elastic deformation after the thickness regulating blade 100 is assembled in the casing 200.

The seal member 130 includes, as shown in FIG. 3, a main part 131 positioned at the base part of the metallic plate 110 and extending in the axial direction, and a side part 132 connected to widthwise end of the main part 131 and extending toward the concave part 121 of the press member 120. The side part 132 has a rear end portion fitted into the concave part 121 so as to be sandwiched between the first side surface 122 and the second side surface 124 and in contact with the first side surface 122, the depth-side surface 123, and the second side surface 124. As shown in FIG. 5(*a*), the rear end portion of the side part 132 is closely in contact with an end surface of the side seal 220 at the downstream side in the rotational direction of the developing roller 53 in order to avoid toner leakage from a gap which may be formed by the side seal 220, the side part 132, and the developing roller 53.

The seal member 130 provides hermetically seals between the thickness regulating blade 100 and the mounting surface 202, and between the thickness regulating blade 100 and the developing roller 53, which prevents the toner leakage from these gaps.

If the seal member 130 were provided at downstream side in the rotational direction of the developing roller 53 from the contact part N, the toner may leak from a gap accidentally formed by the press member 120, the seal member 130, and the developing roller 53. On the other hand, in the embodiment, the depth-side surface 123 of the concave part 121 positioned most downstream side in the rotational direction of the developing roller 53 is aligned with the contact part N in the rotational direction of the developing roller 53. The contact part N extends over the entire width of the thickness regulating blade 100 in the axial direction. Thus, even if the gap is accidentally formed by the press member 120, the seal member 130, and the developing roller 53, the contact part N blocks the toner which may leak to the downstream side in the rotational direction of the developing roller 53 through the formed gap.

The reinforcing member 140 extends in the rightward/leftward direction and located at an opposite side of the opposed surface 110A of the metallic plate 110 where the press member 120 is provided, as shown in FIG. 2. The reinforcing member 140 sandwiches the metallic plate 110 in cooperation with the casing 200 in order to reinforce the metallic plate 110. Providing the reinforcing member 140 on the opposed surface 110A in this way prevents the deformation of the metallic plate 110, provides the base part of the metallic plate 110, and uniforms a contact pressure between the developing roller 53 and the metallic plate 110.

As shown in FIG. 3, the metallic plate 110 is formed with a through hole 111 located at a position outside of an area surrounded by the press member 120 and the seal member 130. The reinforcing member 140 is also formed with a through hole 141 located at a position corresponding to the through hole 111. The through holes 111 and 141 respectively penetrate the metallic plate 110 and the reinforcing member 140 in a thickness direction thereof. As shown in FIG. 2, a screw 150 passes through the through holes 111 and 141 to fix the thickness regulating blade 100 to the mounting surface 202 of the casing 200.

With the metallic plate 110 having this construction, as shown in FIGS. 2 and 5(*a*), the metallic plate 110 is fixed to the mounting surface 202 of the casing 200, and sandwiched by the mounting surface 202 and the reinforcing member 140. The press member 120 located at the rear end portion of the metallic plate 110 is in sliding contact with the circumferential surface of the developing roller 53 while being urged by the metallic plate 110.

Advantageous effects of the embodiment will be described. Because the single seal member 130 seals between the thickness regulating blade 100 and the casing 200, and between the thickness regulating blade 100 and the developing roller 53, the manufacturing cost can be reduced in comparison with a case where a plurality of seal members is provided.

Further, because the seal member 130 is in contact with the concave part 121 of the press member 120 provided on the opposed surface 110A in confrontation with the casing 200, the seal member 130 can be provided without a gap.

Further, because the seal member 130 is in facial contact with the concave part 121, the contact part N providing a direct contact between the developing roller 53 and the press member 120 can be defined continuously from one widthwise end of the thickness regulating blade 100 to the other in the axial direction of developing roller 53. In the embodiment, even if a gap is accidentally formed by the press member 120, the side part 132, and the developing roller 53, the contact part N blocks the toner which may leak from the gap, compared with a case where the side part 132 is located at the outside of the press member 120 in the axial direction without the concave part 121.

The rear end part of the side part 132 is in facial contact with the depth-side surface 123 of the concave part 121, which prevents the toner from leaking via a gap between the seal member 130 and the depth-side surface 123.

Because the depth-side surface 123 of the concave part 121 vertically extends relative to the opposed surface 110A on which the press member 120 is provided, the rear end part of the side part 132 can easily contact the depth-side surface 123 without gap.

The side part 132 of the seal member 130 is in also facial contact with the first side surface 122, which reliably prevents the toner from leaking from the gap between the seal member 130 and the concave part 121.

Because the side part 132 of the seal member 130 is sandwiched between the first side surface 122 and the second side surface 124, the toner leakage from the gap between the seal member 130 and the concave part 121 can be reliably obviated, and the seal member 130 can be easily positioned relative to the press member 120.

While the invention has been described in detail with reference to the embodiment thereof, it would be apparent to those skilled in the art that various changes and modifications may be made therein without departing from the spirit of the invention.

In the above-described embodiment, the side part 132 of the seal member 130 is in contact with the first side surface 122, the depth-side surface 123, and the second side surface 124. However, the present invention is not limited to this configuration. The side part 132 may be in contact with at least a part of the concave part 121. For example, the side part 132 may be in contact with only the depth-side surface 123 of the concave part 121. This prevents toner leakage from the gap between the concave part 121 and the seal member 130.

Figure 6A:
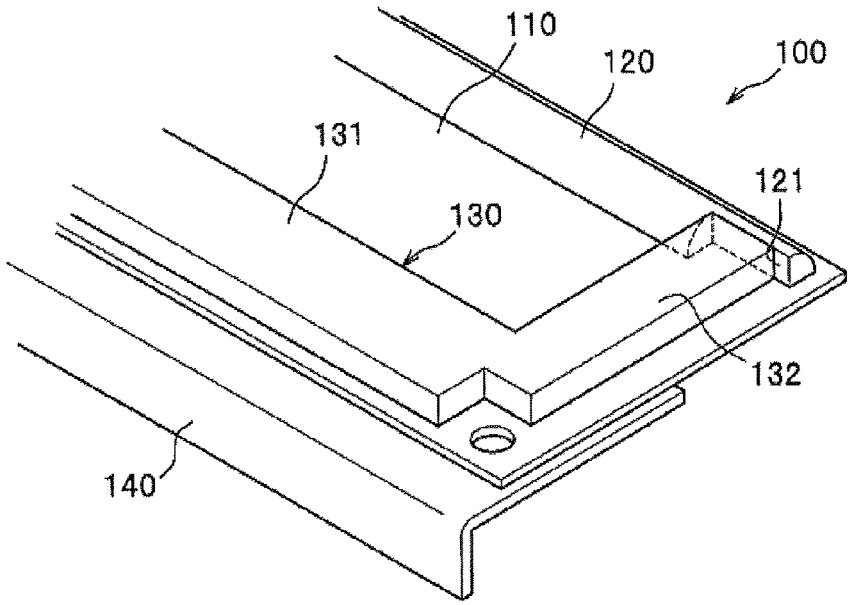
FIG. 6(*a*) is an enlarged perspective view of the left end portion of a thickness regulating blade according to a modification of the embodiment.
Figure 6B:
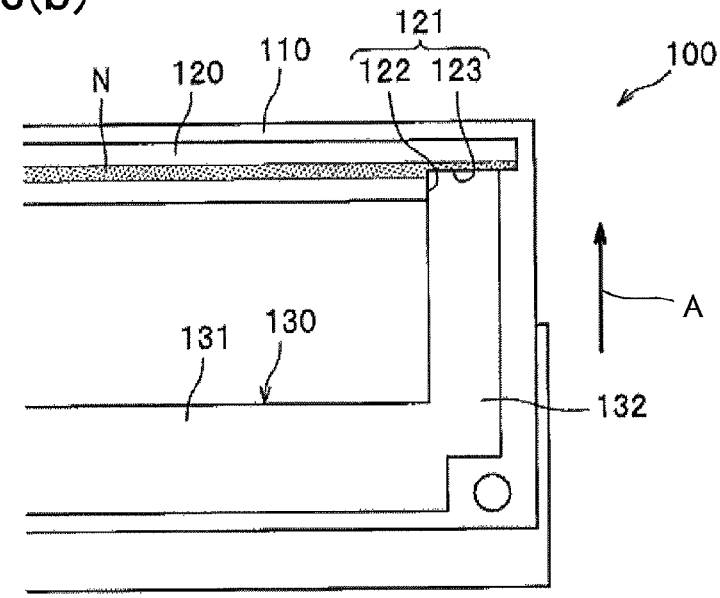

Although, the concave part 121 is of substantially squared U-shape in the above-described embodiment, the present invention is not limited to this configuration. For example, as shown in FIGS. 6(*a*) and 6(*b*), the press member 120 may be cut out so as to be formed with the concave part 121 having substantially L-shape without the second side surface 124. In this modification, a rear end part of the side part 132 is in contact with the first side surface 122 and the depth-side surface 123. Since the concave part 121 is formed in L-shape, the seal member 130 can be easily attached to the metallic plate 110 compared with the above-described embodiment.

Although the color laser printer 1 is employed as an image forming device, the present invention is applicable to a multifunction device or a copying device can be available.

What is claimed is:

1. A developing device comprising:

a casing accommodating developer therein;

a developing roller provided in the casing, having an outer peripheral surface carrying the developer and configured to rotate in a rotational direction;

a thickness regulating blade configured to regulate a thickness of the developer carried on the outer peripheral surface and having an opposed surface confronting the casing, the thickness regulating blade further having one end part supported on the casing and another end part provided with a press member in sliding contact with the outer peripheral surface, the press member being located on the opposed surface and protruding toward the developing roller, the press member being formed with a receiving portion depressed inward at its widthwise ends in an axial direction of the developing roller; and a seal member contacting at least a part of the receiving portion, wherein the receiving portion is configured to receive the seal number and has a contact surface, the contact surface being configured to contact with the seal member and extending in the axial direction of the developing roller, and wherein the seal member is disposed only in an upstream side of the contact surface in the rotational direction of the developing roller.

2. The developing device according to claim 1, wherein the seal member comprises:

a main part extending in the axial direction and having widthwise end portions in the axial direction; and a side part integrally formed with the main part and extending from the widthwise end portions of the main part so as to contact at least the part of the receiving portion.

3. The developing device according to claim 1, wherein the receiving portion is formed such that an upstream side of the press member in a rotational direction of the developing roller is partially cut out.

4. The developing device according to claim 1, wherein:

the contact surface is positioned at a most downstream side of the receiving portion in the rotational direction of the developing roller;

the press member includes a contact part configured to be in direct sliding contact with the outer peripheral surface of the developing roller; and the contact surface is in alignment with the contact part in the rotational direction of the developing roller.

5. The developing device according to claim 4, wherein the receiving portion includes a first side surface extending in the rotational direction of the developing roller, and the contact surface is connected to a downstream end portion of the first side surface in the rotational direction and extends outward in the axial direction.

6. The developing device according to claim 5, wherein the seal member is in contact with the first side surface.

7. The developing device according to claim 6, wherein the receiving portion further includes a second side surface in confrontation with the first side surface, wherein the seal member is sandwiched between the first side surface and the second side surface.

8. The developing device according to claim 4, wherein the contact surface extends orthogonal to the opposed surface of the thickness regulating blade.

* * * * *